US005743382A

United States Patent [19]

Luo

[11] Patent Number: 5,743,382

[45] Date of Patent: Apr. 28, 1998

[54] SWITCH HAVING A DISPLAYING FUNCTION

[75] Inventor: Jenny Luo, Shin-Tien, Taiwan

[73] Assignee: Shin Jiuh Corp., Taipei Hsien, Taiwan

[21] Appl. No.: 706,795

[22] Filed: Sep. 3, 1996

[51] Int. Cl.[6] ..... H01H 9/00

[52] U.S. Cl. ..... 200/315; 200/313; 200/292

[58] Field of Search ..... 200/315, 313, 200/310, 245, 250, 251, 292, 276, 276.1, 314

[56] References Cited

U.S. PATENT DOCUMENTS

| | | | |
|---|---|---|---|
| 3,433,914 | 3/1969 | Ericsson | 200/276.1 |
| 4,293,753 | 10/1981 | Kanada | 200/315 |
| 4,347,417 | 8/1982 | Sorenson | 200/315 |

FOREIGN PATENT DOCUMENTS

| | | | |
|---|---|---|---|
| 2655478 | 6/1978 | Germany | 200/315 |
| 2151990 | 8/1980 | Germany | 200/315 |

*Primary Examiner*—David J. Walczak

[57] ABSTRACT

A switch having a displaying function of the present invention includes a housing, a switching device installed in the housing for performing a switching operation and a displaying device installed in the housing and connecting with the switching device for displaying an ON/OFF status of the switch. The displaying device further includes an indicating element providing the switch status, a resilient element connecting with the indicating element in order that the indicating element provides the switch status in response to the switching operation, and a cushion device connecting with the resilient element for cushioning a pressure imposed thereon during the switching operation in order to lengthen a life of the displaying device.

19 Claims, 4 Drawing Sheets

SWITCH HAVING A DISPLAYING FUNCTION

FIELD OF THE INVENTION

The present invention relates to a switch, especially to a switch having a displaying function.

BACKGROUND OF THE INVENTION

Switch is a necessity for electrical equipments, hence the operating performance of the electrical equipments is certainly dominated by the structure, function, operation mode and life of the utilized switches of the electrical equipments.

Accordingly, an improvement for the switch is an essential issue for obtaining the advantages in all of its application fields.

A switch disposed on a wall for switching a house used lamp is generally provided with an indicating lamp and a relevant circuitry in the switch in order to display the ON/OFF status of the lamp. Consequently, a user can turn on the lamp in the dark by the indication of the indicating lamp of the switch. On the other hand, as the house used lamp is turned on, the indicating lamp is extinguished for saving energy.

Please refer to FIG. 1, in which a conductive piece 32 used to electrically connect with an indicating lamp 31 and a relevant circuitry in the conventional switch having a displaying function is simply shaped by bending an adopted straight metal wire. However, owing to the fact that the shaped conductive piece 32 is merely contemplated for electrically connecting/disconnecting with the indicating lamp 31, some unavoidable defects of the conventional switch result from this simple U-shaped conductive piece 32, and the corresponding inconvenience is accordingly caused.

The relevant defects of the conventional switch having the displaying function are:

(1) A reaction force caused on the contacting terminal 32T as shown in FIG. 1 is totally transmitted to and applied on the soldering spot 32S of the conductive piece 32 as the conductive piece 32 is electrically connected with the circuitry for conducting the indicating lamp. Therefore, the solder attached on the soldering spot 32S is easy to be stripped off and the conductive piece 32 is accordingly broken away.

(2) Moreover, the U-shaped conductive piece 32 of the conventional switch is going to be distorted after a longstanding switching operation, and a poor electrical contact between the contacting terminal 32T and the circuitry together with a non-functional displaying is accordingly caused.

Consequently, in order to overcome the abovementioned defects of the conventional switch having a displaying function, the present invention is therefore invented.

SUMMARY OF THE INVENTION

The major object of the present invention is to provide a switch having a displaying function in order that during the switching operation a reaction force applied on the conductive piece can be cushioned and the operating life of the switch is accordingly extended.

In accordance with the present invention, the switch having a displaying function includes a housing, a switching device installed in the housing for performing a switching operation and a displaying device installed in the housing and connecting with the switching device for displaying an ON/OFF status of the switch, wherein the displaying device further includes an indicating element providing the switch status, a resilient element connecting with the indicating element in order that the indicating element provides the switch status in response to the switching operation, and a cushion device connecting with the resilient element for cushioning a pressure imposed thereon during the switching operation in order to lengthen a life of the displaying device.

In accordance with another aspect of the present invention, the switch is a seesaw-typed switch.

In accordance with another aspect of the present invention, the switch is a push button-typed switch.

In accordance with another aspect of the present invention, the housing includes a top housing and a bottom housing.

In accordance with another aspect of the present invention, the housing further includes a securing metal piece for securing the top housing and the bottom housing.

In accordance with another aspect of the present invention, the switching device includes a push button for performing the switching operation in order to turn the switch ON/OFF, a spring having a first end and a second end connected to the push button and performing an active swing movement in response to the switching operation, an elastic piece having a contacting spot thereof, and supporting the first end of the spring for performing a reactive swing movement in response to the active swing movement, a common terminal having a convexity for supporting the elastic piece and a contacting terminal having a contacting point for electrically contacting with the contacting spot.

In accordance with another aspect of the present invention, the displaying device further includes a positioning piece for connecting with the switching device.

In accordance with another aspect of the present invention, the positioning piece is a printed circuit board.

In accordance with another aspect of the present invention, the indicating element is secured on the printed circuit board by soldering.

In accordance with another aspect of the present invention, the resilient element is secured on the printed circuit board by soldering.

In accordance with another aspect of the present invention, the cushion device is secured on the printed circuit board by soldering.

In accordance with another aspect of the present invention, the displaying device further includes a resistor.

In accordance with another aspect of the present invention, the indicating element is an indicating lamp.

In accordance with another aspect of the present invention, the indicating lamp is a neon light.

In accordance with another aspect of the present invention, the indicating lamp is a light emitting diode (LED).

In accordance with another aspect of the present invention, the displaying device further includes a transparent hood inlaid into the switching device.

In accordance with another aspect of the present invention, the resilient element is made of a conductor.

In accordance with another aspect of the present invention, the resilient element is a copper wire.

In accordance with another aspect of the present invention, the resilient element is a spring.

In accordance with another aspect of the present invention, the spring is a spiral spring.

In accordance with another aspect of the present invention, the spring is a bent spring.

In accordance with another aspect of the present invention, the cushion device is made of conductor.

In accordance with another aspect of the present invention, the cushion device is a copper wire.

In accordance with another aspect of the present invention, the cushion device is a spring.

In accordance with another aspect of the present invention, the spring is a spiral spring.

In accordance with another aspect of the present invention, the spring is a bent spring.

In accordance with another aspect of the present invention, the cushion device and the resilient device are integrally formed.

In accordance with another aspect of the present invention, the switch status is a first status in a first instance and a second status in a second instance.

In accordance with another aspect of the present invention, the first status is an OFF status of the switch.

In accordance with another aspect of the present invention, the resilient device contacts with the switching device.

In accordance with another aspect of the present invention, the indicating element is in an active state.

In accordance with another aspect of the present invention, the second status is an ON status of the switch.

In accordance with another aspect of the present invention, the resilient element is separated from the switching device.

In accordance with another aspect of the present invention, the indicating element is in a passive state.

BRIEF DESCRIPTION OF THE DRAWING

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following description of the preferred embodiments of the present invention are presented herein for purpose of illustration and description only; it is not intended to be exhaustive or to be limited to the precise form disclosed.

Figure 1:
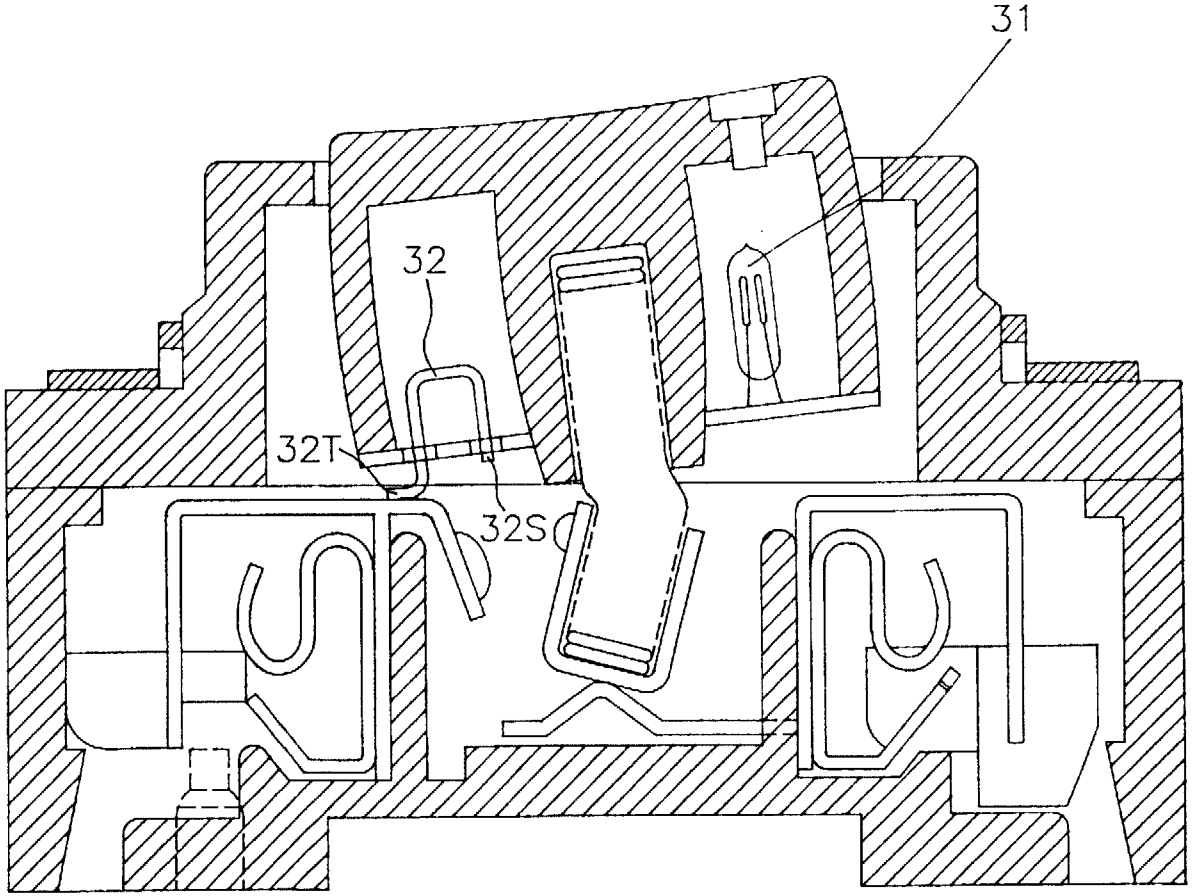
Fig. 1(PRIOR ART)
FIG. 1 is a perspective sectional view of a conventional switch.
Figure 2:
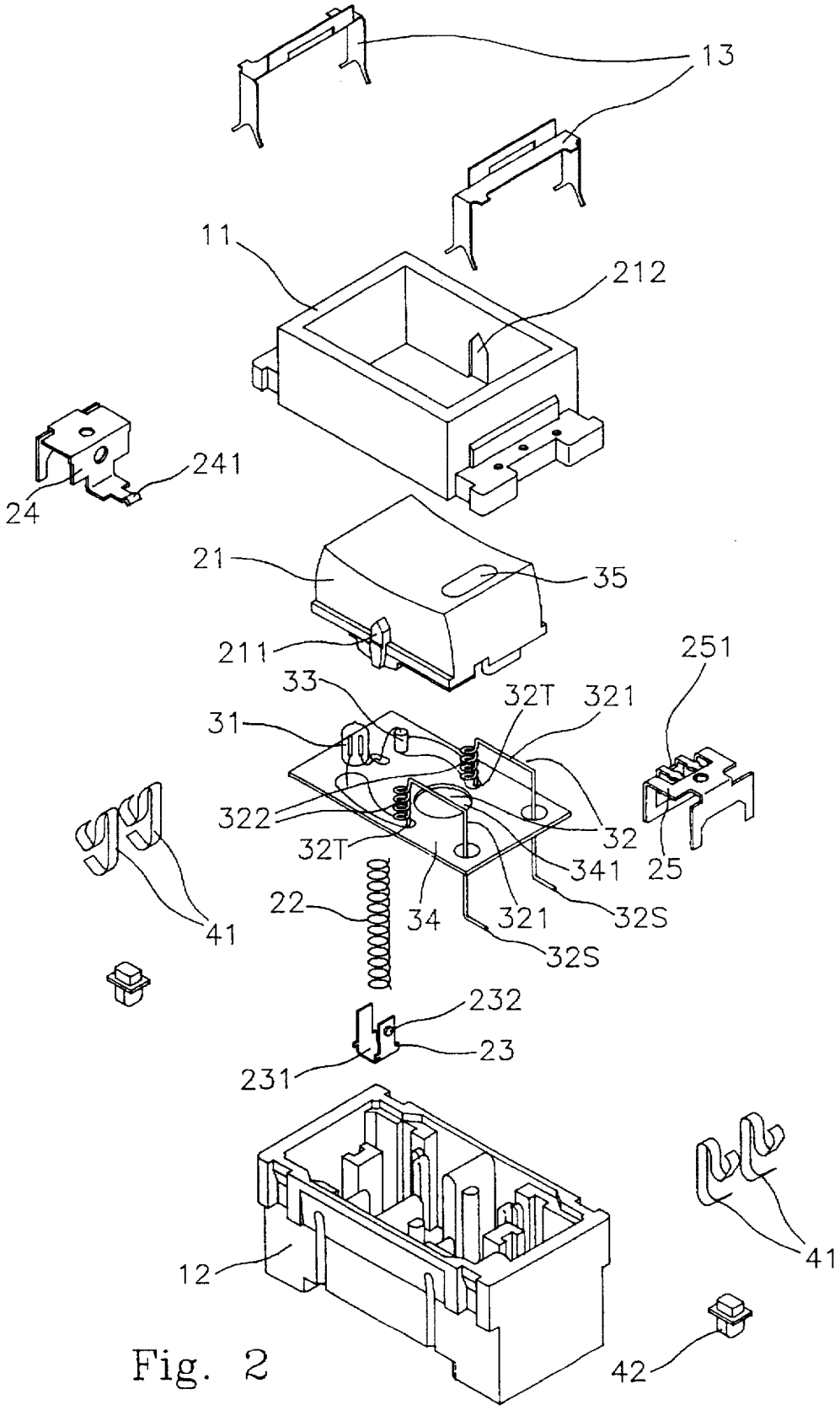
FIG. 2 is a schematic view showing the disassembled parts of a switch having an indicating lamp according to a preferred embodiment of the present invention.

Please refer to FIG. 2, which is a schematic view showing the disassembled parts of a switch having an indicating lamp according to a preferred embodiment of the present invention, which includes a top housing 11, a bottom housing 12, securing metal pieces 13, a push button 21, protrusions 211, recesses 212, a spring 22, an elastic piece 23, a supporting point 231, a contacting spot 232, a common terminal 24, a convexity 241, a contacting terminal 25, a contacting point 251, a neon light 31, resilient elements 321, a cushion device 322 configured as a conductive wire for electrically connecting with the neon light 31, a resistor 33, a printed circuit board 34, a transparent hood 35, clamping pieces 41 and clamping stops 42.

A switching device is assembled by the push button 21 having thereon the protrusions 211 and the recesses 212, the spring 22, the elastic piece 23 having thereon the supporting point 231 and the contacting spot 232, the common terminal 24 having the convexity 241 and the contacting terminal 25 having the contacting point 251. A displaying device is an assemblage of the neon light 31, the resilient elements 321, the cushion device 322, the resistor 33, the printed circuit board 34 being a positioning piece for connecting with said with the switching device and the transparent hood 35.

The switch having an indicating lamp is assembled by using the bottom housing 12 for sequentially assembling the clamping stops 42, the clamping pieces 41, the common terminal 24 and the contacting terminal 25, and then locating the elastic piece 23 on the convexity 24. In addition, the push button 21 inlaid with the transparent hood 35 is combined with the top housing 11 by engaging the protrusions 211 with the recesses 212. Thereafter, the printed circuit board 34 soldered thereon the neon light 31, the conductive piece 32 and the resistor 33 is secured under the push button 21, and the spring 22 passes through a hole 341 of the printed circuit board 34 for respectively connecting one end thereof with the push button 21 and the other end thereof with the supporting point 231. Finally, the switch having an indicating lamp according to the preferred embodiment of the present invention is obtained by combining the respective assembled top housing 11 and bottom housing 12 via employing the securing metal piece 13. The ON/OFF status of the lamp is therefore switchable by electrically contacting the contacting spot 232 and the contacting point 251.

Accordingly, the characteristic of the present invention is that the conductive piece 32 for electrically connecting with the neon light 31 includes a resilient element 321 and a cushion device 322, wherein the resilient 321 and the cushion device 322 are integrally formed by using a conductor material.

According to the preferred embodiment of the present invention, the resilient element 321 for contacting with the contacting terminal 25 is formed by directly bending a straight portion of a copper wire. On the other hand, the other portion of this used copper wire is shaped to form a spiral spring in order to be employed as the cushion device 322. Accordingly, the reaction force occurred at the soldering point 32S of the conductive piece 32, which is caused by the contact occurred between the contacting terminal 32T of the conductive piece 32 and the contacting terminal 25 is therefore cushioned. Consequently, not only the conductive piece 32 is not easy to be distorted and broken off but the solder soldered on the contacting spot 32S of the conductive piece 32 is also not easy to be stripped off. Hence, a switch having a reliable displaying function is achieved.

Figure 3:
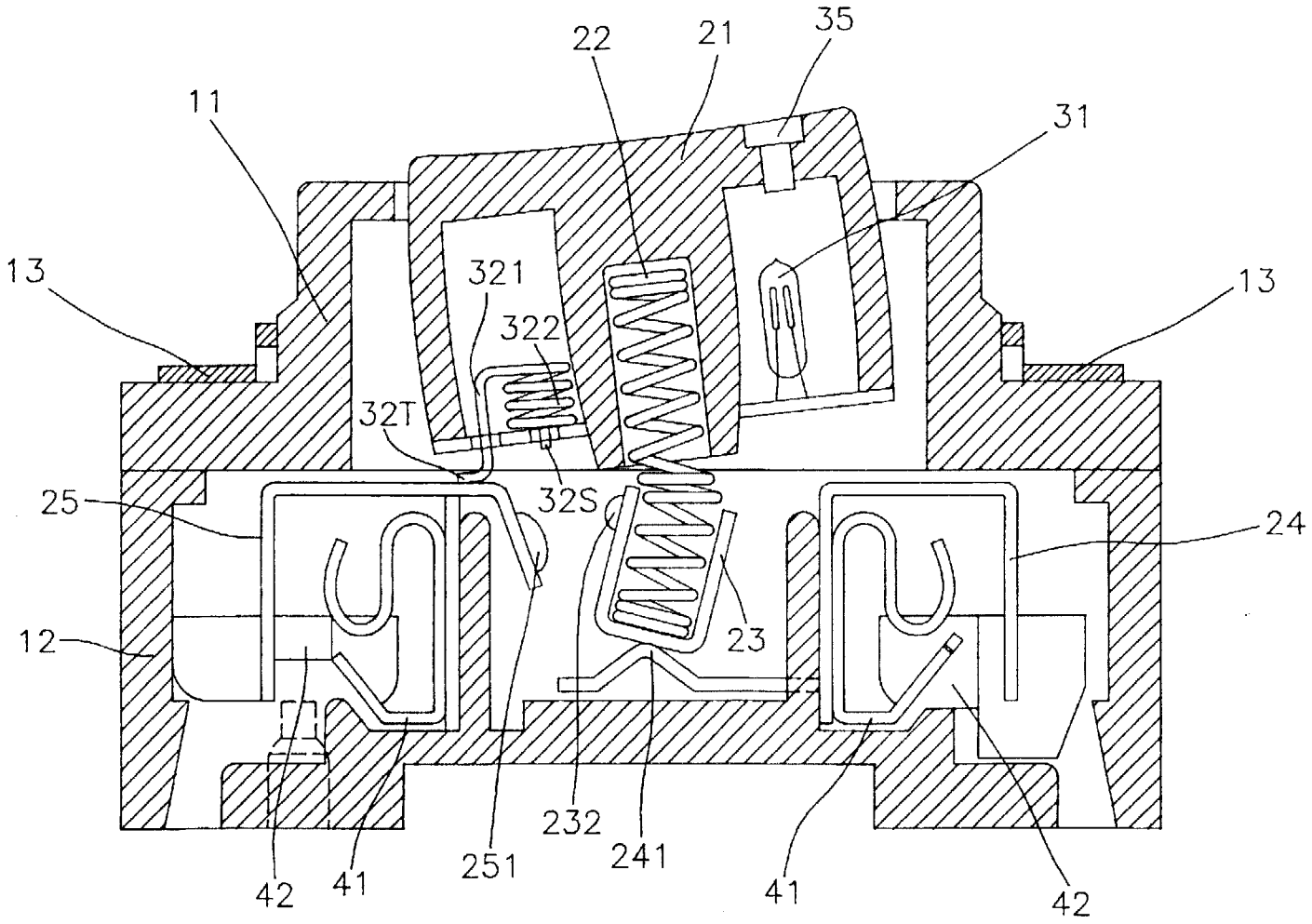
FIG. 3 is a perspective sectional view showing an active state of the switch having an indicating lamp according to the preferred embodiment of the present invention.

Please refer to FIG. 3. As the contacting spot 232 is electrically disconnected with the contacting point 251, the lamp is in a passive state, while the indicating lamp 31 is in an active state, owing to the electrical connection between the conductive piece 32 and the contracting terminal 25.

The cushion device 322 of the present invention is used for cushioning a pressure imposed on the contacting terminal 32T of the conductive piece 32 during the switching operation occurred between the conductive piece 32 and the contacting terminal 25. Therefore, an improved conductive piece 32 having the characteristics of not being easy to be distorted and broken off is obtained. Accompanying with a better design of the resilient 321 and the cushion device 322, an excellent conductive effect can be achieved, as the conductive piece 32 electrically connects with the contacting terminal 25.

Figure 4:
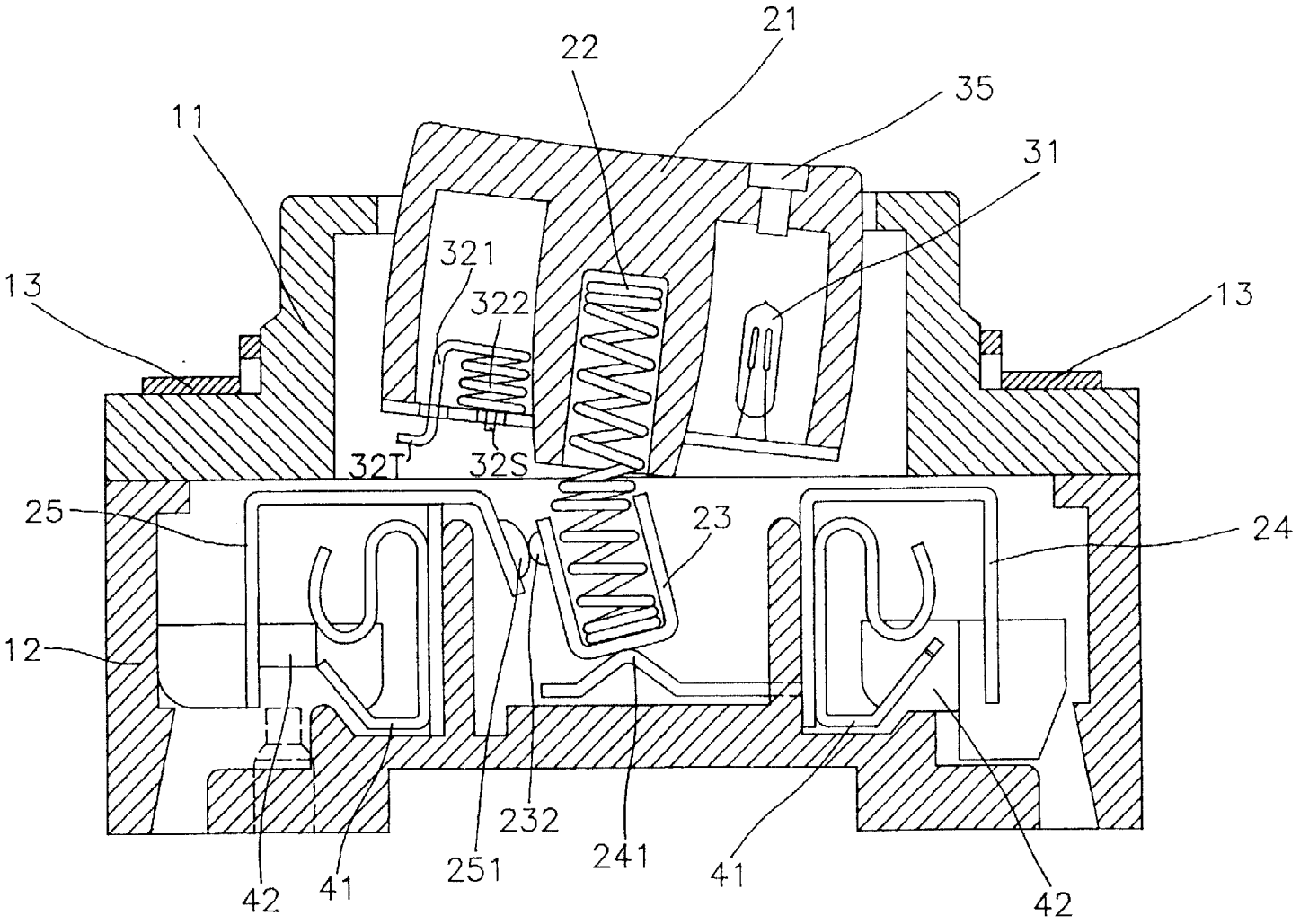
FIG. 4 is a perspective sectional view showing a passive state of the switch having an indicating lamp according to the preferred embodiment of the present invention.

Referring to FIG. 4, when the contacting spot 232 electrically contacts with the contacting point 251, the lamp is in an active state, while the indicating lamp 31 is in a passive state, owing to the electrical disconnection between the conductive piece 32 and the contact terminal 25.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A switch having a displaying function, comprising:

a housing:

a switching device installed in said housing for performing a switching operation: and a displaying device installed in said housing for displaying an ON/OFF status of said switch, wherein said displaying device further comprises:

a positioning piece for connecting with said switching device, wherein said positioning piece is a printed circuit board;

an indicating element providing said switch status;

a resilient element connecting with said indicating element in order that said indicating element provides said switch status in response to said switching operation; and a spiral spring cushion device connecting with said resilient element for cushioning a pressure imposed thereon during said switching operation.

2. A switch having a displaying function as claimed in claim 1, wherein said switch is a seesaw-typed switch.

3. A switch having a displaying function as claimed in claim 1, wherein said switch is a push button-typed switch.

4. A switch having a displaying function as claimed in claim 1, wherein said housing includes a top housing and a bottom housing.

5. A switch having a displaying function as claimed in claim 4, wherein said housing further includes a securing metal piece for securing said top housing and said bottom housing.

6. A switch having a displaying function as claimed in claim 1, wherein said switching device includes:

a push button for performing said switching operation in order to turn said switch ON/OFF;

a spring having a first end and a second end connected to said push button and performing an active swing movement in response to said switching operation;

an elastic piece having a contacting spot thereof, and supporting said first end of said spring for performing a reactive swing movement in response to said active swing movement;

a common terminal having a convexity for supporting said elastic piece; and a contacting terminal having a contacting point for electrically contacting with said contacting spot.

7. A switch having a displaying function as claimed in claim 1, wherein said indicating element is secured on said printed circuit board by soldering.

8. A switch having a displaying function as claimed in claim 1, wherein said resilient element is secured on said printed circuit board by soldering.

9. A switch having a displaying function as claimed in claim 1, wherein said spring cushion device is secured on said printed circuit board by soldering.

10. A switch having a displaying function as claimed in claim 1, wherein said displaying device further includes a resistor.

11. A switch having a displaying function as claimed in claim 1, wherein said indicating element is an indicating lamp.

12. A switch having a displaying function as claimed in claim 11, wherein said indicating lamp is a neon light.

13. A switch having a displaying function as claimed in claim 11, wherein said indicating lamp is a light emitting diode (LED).

14. A switch having a displaying function as claimed in claim 1, wherein said displaying device further includes a transparent hood inlaid into said switching device.

15. A switch having a displaying function as claimed in claim 1, wherein said resilient element is made of a conductor.

16. A switch having a displaying function as claimed in claim 15, wherein said resilient element is a spring.

17. A switch having a displaying function as claimed in claim 1, wherein said cushion device is made of conductor.

18. A switch having a displaying function as claimed in claim 1, wherein said spring cushion device and said resilient element are integrally formed.

19. A switch having a displaying function as claimed in claim 1, wherein said switch status is a first status in a first instance and a second status in a second instance.

* * * * *